United States Patent [19]

Hall, deceased

[11] 4,227,875

[45] Oct. 14, 1980

[54] ROTARY HEARTH FOR CALCINING KILN

[75] Inventor: Hubert L. Hall, deceased, late of Nassau, The Bahamas, by Noel S. Roberts, executor

[73] Assignee: Calcimatic International Limited, Grand Cayman, Cayman Islands

[21] Appl. No.: 941,745

[22] Filed: Sep. 12, 1978

[51] Int. Cl.[3] ..... F27D 3/00

[52] U.S. Cl. ..... 432/239; 432/124

[58] Field of Search ..... 432/239, 124

[56] References Cited

U.S. PATENT DOCUMENTS 3,345,052 10/1967 Hall ..... 432/1

FOREIGN PATENT DOCUMENTS 1246016 10/1960 France ..... 432/239

*Primary Examiner*—John J. Camby

*Attorney, Agent, or Firm*—Shenier & O'Connor

[57] ABSTRACT

A rotary hearth for a kiln assembly in which the refractory material-bearing portion of the hearth is supported by a metal frame from below and is contained peripherally by a refractory buttress secured to the frame. In the preferred form of the invention, the refractory buttress comprises a lower layer of slightly circumferentially spaced buttress block and an upper layer of refractory rim tiles interlocking with the buttress blocks. The hearth is free of metal structural components in regions of high heat and thus free from the problems of cracking and jamming associated with assemblies of the prior art.

10 Claims, 7 Drawing Figures

Fig 1
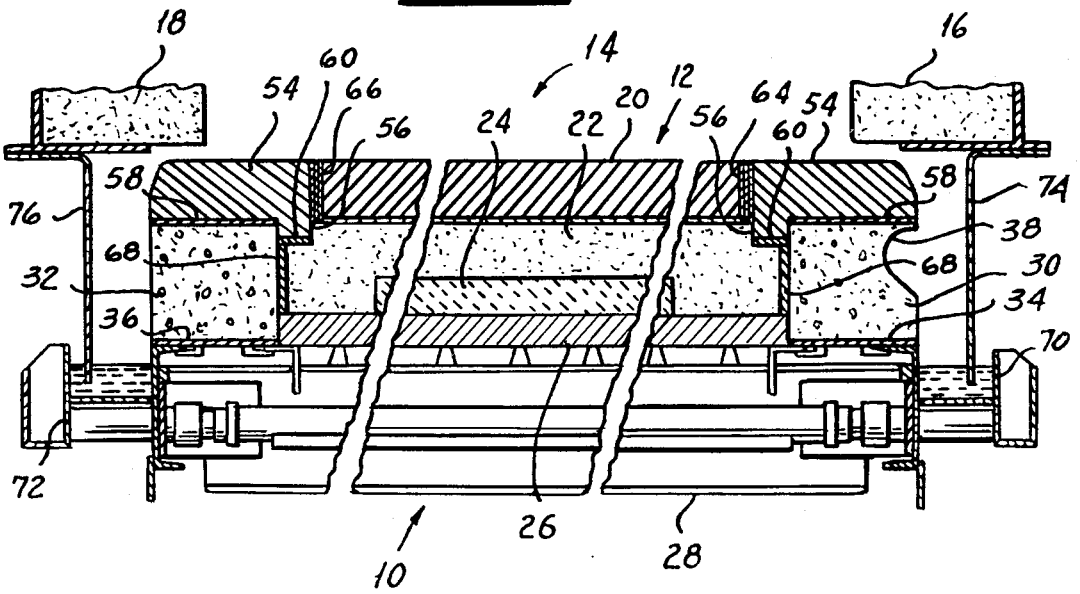
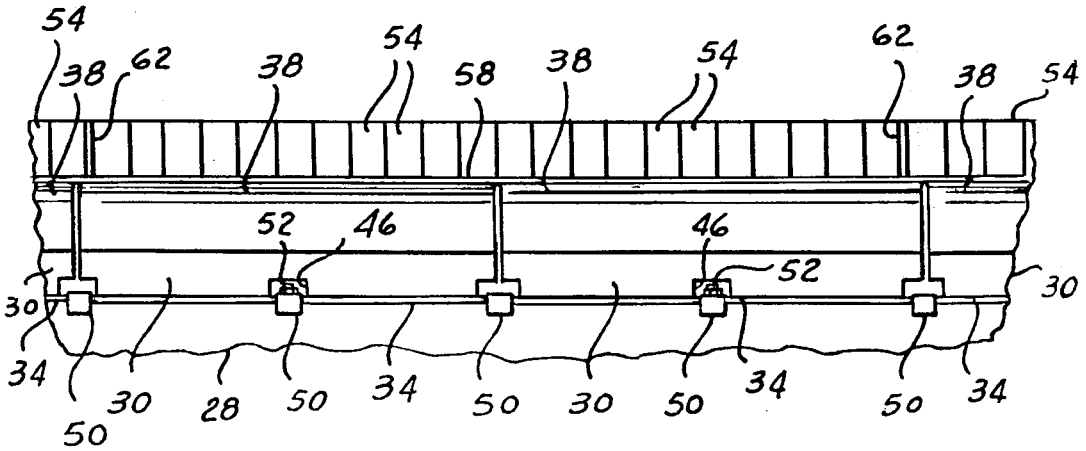
Fig 2

ROTARY HEARTH FOR CALCINING KILN

BACKGROUND OF THE INVENTION

This invention relates to an improved construction of a rotary hearth such as used in calcining kiln.

As is known in the prior art, limestone, which is largely calcium carbonate, is reduced to lime or calcium oxide by subjecting the limestone to high heat for a predetermined period of time. In one method of calcining, shown for example in U.S. Pat. No. 3,345,052, issued to Hubert L. Hall, limestone is deposited in the form of small pellets on the surface of an annular hearth which is rotated continuously on a vertical axis to carry the pellets through successive heating zones of an annular kiln. After the pellet material has been reduced to lime and at a certain point along the circular course, a belt or the like with vanes or pushers sweeps the lime outwardly onto a stationary chute down which the lime slides into a hopper or the like.

In kiln assemblies of the prior art, the rotating hearths have used steel plate, castings or a combination of both to retain the refractory material. While this type of construction provides peripheral containment of the refractory material, unequal expansion of metal and refractory portions of the hearth due to heat often results in cracking of the refractory material and jamming of the hearth.

SUMMARY OF THE INVENTION

One object of the present invention is to provide a rotary hearth which adequately retains the refractory material.

Another object of the present invention is to provide a rotary hearth which resists cracking of the refractory material and jamming of the hearth.

In general, the present invention contemplates a rotary hearth for a kiln assembly in which the refractory material-bearing portion of the hearth is supported by a metal frame from below and is contained peripherally by a refractory buttress secured to the frame by any suitable means. Preferably the refractory buttress comprises a lower layer of slightly circumferentially spaced buttress blocks and an upper layer of refractory rim tiles interlocking with the buttress blocks. By forming the inner and outer retaining portions of a refractory material rather than steel plate or castings, one is able to avoid the problems of cracking and jamming associated with kiln assemblies of the prior art.

BRIEF DESCRIPTION OF THE DRAWINGS

In the accompanying drawings to which reference is made in the instant specification and in which like reference characters are used to indicate like parts in the various views:

FIG. 1 is a fragmentary section of a kiln assembly constructed according to the present invention.

FIG. 2 is a fragmentary elevation of the outer rim of the hearth of the assembly shown in FIG. 1.

DETAILED DESCRIPTION OF THE PREFERRED EMBODIMENT

Figure 3:
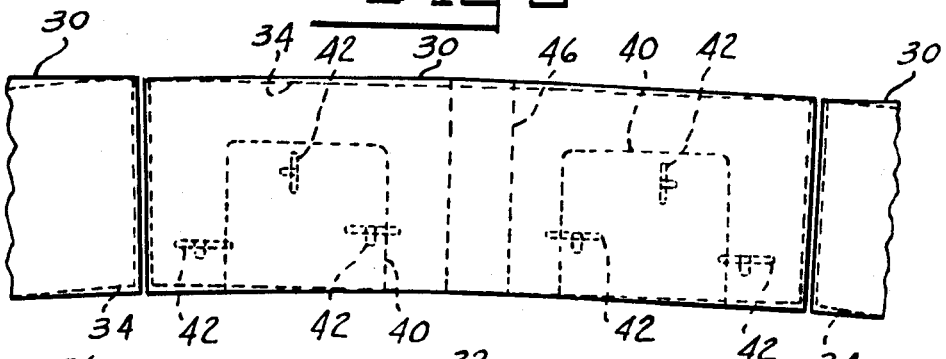
FIG. 3 is a fragmentary top plan showing the arrangement of the outer buttress blocks of the assembly of FIG. 1.
Figure 4:
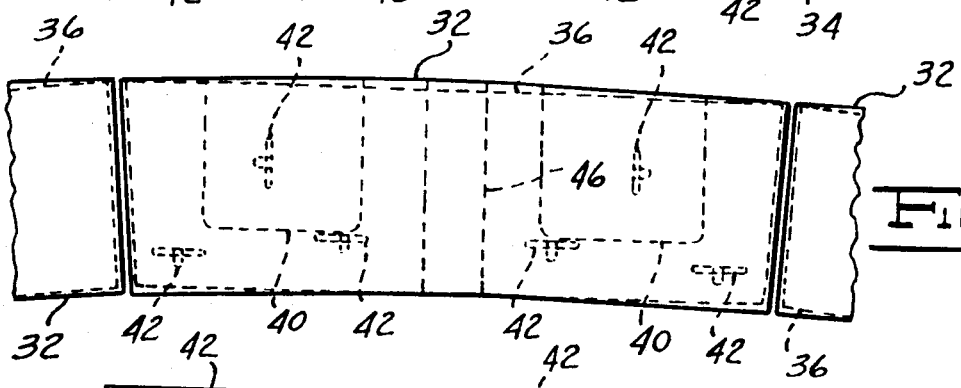
FIG. 4 is a fragmentary top plan showing the arrangement of the inner buttress blocks of the assembly of FIG. 1.

Referring now to the drawings, the kiln assembly in which the present invention is used, indicated generally by the reference numeral 10, includes an annular hearth, indicated generally by the reference numeral 12, which is rotated about a vertical axis by means not shown. Respective outer and inner kiln walls 16 and 18 define a kiln area 14 immediately above the hearth 12 through which limestone pellets are conveyed to convert them to lime. Kiln area 14 also has an upper wall not shown. Preferably, the hearth 12 is composed of multiple layers including an upper layer 20 and intermediate layers 22, 24 and 26 comprising various grades of refractory material. A steel supporting frame 28 adapted to move along circumferential tracks (not shown) and coupled to a suitable power source supports the refractory layers 20, 22, 24, 26 from below.

A plurality of respective outer and inner buttress blocks 30 and 32 are used to peripherally contain the refractory layers 20, 22, 24, 26. Each of the buttress blocks 30 and 32 comprises a suitable refractory material, such as the material sold by Canadian Refractories of Hamilton, Ontario, under the trademark KR 3, and is circumferentially spaced from the adjacent buttress blocks by a gap of preferably ¼ inch for a block length of 35 inches. Outer and inner buttress blocks 30 and 32 in turn rest on respective outer and inner steel buttress plates 34 and 36.

Buttress plates 34 and 36, which generally underlie the individual blocks 30 and 32, are separated from one another by a somewhat greater circumferential spacing, preferably about 1 inch. Outer buttress blocks 34 are each formed with a circumferentially extending indentation 38 on the outer face thereof to accept the lip of a discharge chute (not shown), as described more particularly in the copending application of Percy V. Bourne, Ser. No. 893,893, filed Apr. 6, 1978. If desired, the unexposed lower portions of buttress blocks 30 and 32 may comprise refractory inlays 40 of an intermediate type similar to the material of the lowest refractory layer 26. A suitable such material is sold by Skarrehage Molervaerk A/S of Denmark, under the trademark Skamol. Stainless steel anchors 42 secured to buttress plates 34 and 36 by any suitable means reinforce blocks 30 and 32 while at the same time mechanically securing them to plates 34 and 36. Preferably, each of the outer buttress blocks 34 also includes a horizontally disposed mesh reinforcement 44 in the region above the indentation 38.

Figure 5:
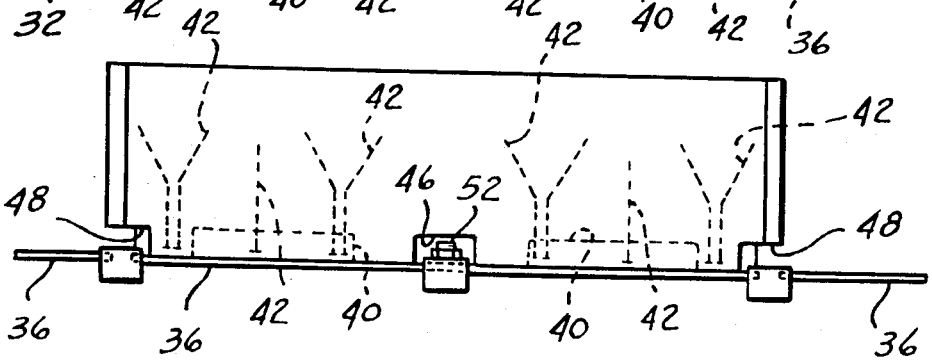
FIG. 5 is a side elevation of one of the inner buttress blocks shown in FIG. 4.
Figure 6:
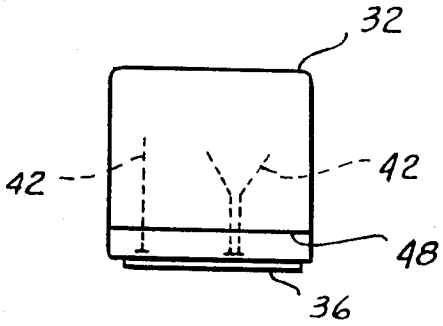
FIG. 6 is an end elevation of one of the inner buttress blocks shown in FIG. 4.
Figure 7:
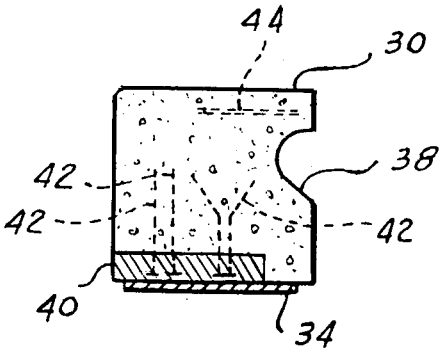
FIG. 7 is a section of the outer buttress plate shown in FIG. 3.

Each buttress plate 34 or 36 is in turn secured to the supporting frame 28 by clamps 50 extending radially across the center of the block 30 or 32 and across the ends of adjoining plates. Radially extending center channels 46 and end channels 48 formed along the bottom of blocks 30 and 32 provide clearance for clamps 50. Buttress plates 34 and 36 are fixedly attached to the clamps 50 spanning the center channels 46 and the supporting frame 28 by any suitable means such as bolts 52 spaced across the width of the plates, but are left free to expand circumferentially at their ends, as shown in FIG. 5.

A plurality of individual outer and inner rim tiles 54, generally overlying the outer and inner buttress blocks 30 but also having inwardly (i.e., toward the interior of the annulus) and downwardly extending keyed portions 56 to interlock with the blocks, form the upper rims of the hearth 12. Grout layers 58 and 60 provide a buffer between rim tiles 54 and the buttress blocks 30, 32 and refractory layer 22, respectively. Rim tiles 54, formed of a suitable refractory material such as the material sold by Harbison-Walker of Pittsburgh, Pennsylvania, under the trademark Alamo S, are preferably about 4-½ inches high at the outer edge, about 14 inches deep and about 3 inches wide (i.e., circumferentially). Preferably, rim tiles 54 are arranged into groups of about 20 to 25 tiles separated from one another by ½-inch expansion joint boards 62.

Respective expansion joint boards 64 and 66, preferably about ¼ inch thick for a hearth having an inner diameter of 45 feet and an outer diameter of 90 feet, separate the outer and inner rim tiles 54 from the upper refractory layer 20. Similarly, expansion joint boards 68, preferably about 1 inch thick for the outer buttress block 30 and about ½ inch thick for the inner buttress block 32, separate the buttress blocks from the intermediate refractory layer 22. Supporting frame 28 carries respective outer and inner peripherally extending water troughs 70 and 72 which, together with stationary baffle plates 74 and 76, form a heat seal.

The above-described structure results in an annular high-heat region corresponding generally to the kiln area 14, annular intermediate-heat regions defined by the hearth edges and the baffle plates 74 and 76 radially and by the kiln walls 16 and 18 and water troughs 70 or 72 vertically, and a low-heat region outside the baffle plates and below the water troughs. The metal frame 28 lies almost entirely in a low-heat region, while the small portion exposed to the intermediate-heat region beneath the buttress blocks 30, 32 is kept at a relatively low temperature by the water in the troughs 70, 72. The hearth 12 is thus free of metal structural components in regions of high or intermediate heat and their associated problems of cracking and jamming due to unequal expansion.

It will be understood that certain features and subcombinations are of utility and may be employed without reference to other features and subcombinations. This is contemplated by and is within the scope of the appended claims. It is further obvious that various changes may be made in details within the scope of these claims without departing from the spirit of this invention. It is, therefore, to be understood that this invention is not to be limited to the specific details shown and described.

Having thus described this invention, what I claim is:

1. A rotary hearth for a kiln assembly including in combination a circular refractory layer adapted to support material to be heated, a metal undercarriage supporting said refractory layer, a refractory buttress peripherally containing said refractory layer, and means for securing said buttress to said undercarriage, said refractory buttress being unconfined peripherally to permit free expansion and contraction without contact between the peripheral surface thereof and said undercarriage.

2. A hearth as in claim 1 in which said refractory layer is an annular layer contained on its outer periphery by said refractory buttress, said hearth further comprising an inner refractory buttress containing the inner periphery of said annular refractory layer.

3. A hearth as in Claim 1 in which said buttress comprises a plurality of circumferentially spaced buttress portions.

4. A hearth as in claim 3 in which said securing means comprises a plurality of circumferentially spaced metal plates secured to the undersides of said refractory buttress portions and means for securing said plates to said undercarriage.

5. A hearth as in claim 7 in which said buttress portions and said metal plates are circumferentially elongated, said plates being secured to said undercarriage at intermediary portions thereof and being free to expand and contract circumferentially at the ends thereof relative to said undercarriage.

6. A hearth as in claim 1 in which said refractory buttress is secured to said undercarriage along the underside of said buttress.

7. A hearth as in claim 7, further comprising a refractory rim peripherally containing said refractory layer, said rim overlying said buttress.

8. A hearth as in claim 7 in which one of said buttress and said rim is formed with a key portion peripherally containing said rim relative to said buttress.

9. A hearth as in claim 7 in which said rim is formed with a key portion extending downwardly and inwardly of said buttress.

10. A hearth as in claim 7 in which said rim is formed of the same material as the upper portion of said refractory layer.

* * * * *

UNITED STATES PATENT AND TRADEMARK OFFICE

CERTIFICATE OF CORRECTION

PATENT NO. : 4,227,875

DATED : October 14, 1980

INVENTOR(S) : Hubert L. Hall, deceased

It is certified that error appears in the above-identified patent and that said Letters Patent are hereby corrected as shown below:

Column 4, line 27, "claim 7" should read -- claim 4 --;

line 36, "claim 7" should read -- claim 1 --.

Signed and Sealed this

*Thirteenth* Day of *January 1981*

[SEAL]

*Attest:*

SIDNEY A. DIAMOND

*Attesting Officer*

*Commissioner of Patents and Trademarks*